United States Patent [19]

Napier

[11] 4,225,397

[45] Sep. 30, 1980

[54] NEW AND UNIQUE ALUMINUM PLATING METHOD

[75] Inventor: Garrett H. Napier, Erie, Mich.

[73] Assignee: Ford Motor Company, Dearborn, Mich.

[21] Appl. No.: 957,787

[22] Filed: Nov. 6, 1978

[51] Int. Cl.[3] ..... C25D 5/30

[52] U.S. Cl. ..... 204/29; 204/33

[58] Field of Search ..... 204/33, 29, 58

[56] References Cited

U.S. PATENT DOCUMENTS

| | | | |
|---|---|---|---|
| 2,067,703 | 1/1937 | Robinson et al. | 204/33 |
| 2,233,410 | 3/1941 | Frasch | 204/33 |
| 2,893,931 | 7/1959 | Boyett | 204/33 |
| 3,753,882 | 8/1973 | Missel | 204/33 |

OTHER PUBLICATIONS

William Travers, "Plating on Aluminum," Electrochemical Society Preprint 75-5, May 1, 1939.

Harold Work, "Electroplating on Aluminum from Cyanide Solutions," Electrochemical Society Preprint 60-69, Sep. 7, 1931.

*Primary Examiner*—John H. Mack

*Attorney, Agent, or Firm*—Joseph W. Malleck; Keith L. Zerschling

[57] ABSTRACT

A method of plating aluminum parts is disclosed, which provides improved adhesion of the plated system with decreased restraints on transfer time between steps. The aluminum part must contain 1-8% alloyed zinc and be cleaned to be free of grease and organic contaminants, such as by the use of alkaline and etching cleaners. The part is then cathodically cleaned employing sulfuric acid, to be free of any oxide film. While in the latter condition, cyanide and borate salts are cathodically deposited (Ph 7.5-10.5) permitting increased transfer time, up to 1 hour, before metal plating. The salt coated part is immersed in an electrolytic cell to displace the salt coating with a bronze strike containing 58-88% tin. Finally a lustrous decorative coating system is plated thereover.

11 Claims, No Drawings

NEW AND UNIQUE ALUMINUM PLATING METHOD

BACKGROUND OF THE INVENTION

The primary consideration in electroplating aluminum or aluminum alloys is the presence of an oxide film on the aluminum surface which prevents adequate and uniform adhesion of plating deposits. The oxide film is sometimes considered a natural film because it is consistently present on aluminum when exposed to the atmosphere or to any medium that contains oxygen. Even though the film be removed, it forms extremely rapidly upon re-exposure to oxygen. Due to aluminum's high affinity for oxygen and to its position in the electromotive series, being anodic to all common metals except zinc and cadmium, the commercial application of electroplated aluminum alloys has been severely limited.

Historical efforts to achieve good adhesion of electroplating on aluminum, has included the use of a direct plated zinc layer as early as 1931, but more recent efforts have included the use of an immersion zincate treatment, and a tin/bronze pre-plating.

A number of pre-plating treatments or underlayment systems have been employed by the prior art with the hope of solving the adherency problem. Those which have achieved some degree of commercial use fall into basically three categories: (a) the use of zinc because zinc is anodic to aluminum and can be deposited by immersion, (b) a tin/bronze underlayment, tin being anodic to zinc, or (c) a phosphoric acid anodized underlayer. Zinc, as a heavy plated underlayment, has been reportedly used as early as 1931. But more recent efforts have employed zinc by an immersion technique commonly referred to as a zincate treatment. Unfortunately, the immersion technique is more an art than a science because the actual control parameters of the process are not well understood and undesirable variances appear. The extremely high zinc content of the underlayment is readily attacked and dissolved in subsequent acid dips or plates necessary to electroplating nickel if not protected by additional barrier elements or double thickness. Most importantly, the presence of the zinc in contact with the aluminum, sets up an electrolytic cell which promotes lateral corrosion along the zinc layer, the zinc being sacrificial, after a slight scratch or fracture occurs through the outer plated system.

The tin/bronze pretreatment employs an electrolytic or immersion tin deposit to delay the oxidation of the aluminum. In order to avoid the generation of blisters within the underlayment, the transfer time of the aluminum parts between the tin bath and the bronze bath is unfortunately limited to 12 seconds or less. Almost all available production equipment is not capable of consistently carrying out such a rapid transfer time and therefore the use of the tin/bronze technique on most plating plants does not render successful plating results.

Phosphoric acid anodizing generates a very thin film of aluminum oxide which is tightly adhered to the aluminum substrate, and in turn is employed to bond to the outer metallic coatings. However, the oxide film is extremely brittle (equivalent to the brittleness of glass) and will fracture with slight deformation. Moreover, the oxide film as the initial deposit, is technically a mere coating; consequently the adhesion of the subsequent metallic overlayers to the aluminum substrate becomes a mechanical attachment rather than a molecular bond as is normal in electroplating. The net result is a much poorer attachment of the plating system.

SUMMARY OF THE INVENTION

A primary object of this invention is to provide an economical and easily controllable plating system for aluminum alloys, particularly high strength aluminum alloys, the coating system providing a high degree of adherency to the aluminum substrate and at the same time providing for improved lateral corrosion resistance.

Another object of this invention is to provide a pretreatement for a lustrous decorative metallic coating system applied to an aluminum substrate (i.e. aluminum auto bumpers) for applications in a highly corrosive environment. The pretreatment improvement permits exposure of the cleansed aluminum substrate during processing to the atmosphere for increased handling periods, up to 1 hour, while at the same time inhibiting oxidation of said cleansed substrate prior to the application of the plating system. The attainment of the increased inhibition to processing oxidation permits the use of conventional production equipment, requiring less capital expenditures, and permitting less critical handling operations within the plant facility.

Features pursuant to the above objects comprise: (a) the use of an aluminum alloy substrate containing 1–8% zinc, (b) after conventional degreasing and cleansing steps, the aluminum substrate is subjected to a cathodic cyanide treatment employing an electrolyte having cyanide and borate salts which when deposited form a protective layer on the cleansed aluminum substrate; (c) the alkality of the cathodic cyanide solution is critically maintained at a pH range of 9.0–10.5, while other electrolytic cell parameters such as temperature, current density and time are held to less critical standards, temperature being within the operable range of 60°–180° F., current density being within the range of 10–30ASF, and time within the range of 0.75–2 minutes; and (d) the first plating layer should preferably be a bronze strike containing 58–88% tin.

DETAILED DESCRIPTION

The invention is concerned with employing aluminum as a light weight substrate upon which is plated a bright lustrous decorative metallic finish, typically comprised of nickel and chromium. Electroplating of aluminum in commercial practice necessitates the use of an intermediate chemical pretreatment which has earlier been referred to as consisting either of an immersion layer of zinc, commonly applied by the zincate process, or by use of other layers such as tin, or by the use of phosphoric acid anodizing. Each of these methods have their deficiency as pointed out earlier.

Each of these methods have the deficiencies defined earlier, of zinc corroding laterally along the aluminum interface, the transfer time constraints of the tin/bronze system, and extreme brittleness of phosphoric acid anodizing. They require exacting protection of the oxide free surface prior to deposition of a pretreatment system which places an unfavorable constraint on the transfer time between baths of the aluminum parts. It has been found as a result of this invention that such criticality of transfer time and precautions against exposure to the atmosphere, can be alleviated significantly by the deposition of a non-metallic chemical solution containing salts which adhere as a surface film on the cleansed aluminum preventing oxidation of the aluminum for a period of up to 1 hour when exposed to the atmosphere. Heretofore, it has been the general belief of the prior art that there does not exist a mode by which oxidation of an aluminum surface can be inhibited by a liquid film. Moreover, the prior art has found a number of undesirable side effects with each of the attempted pretreatments used to solve the oxidation problem; there are no disadvantageous side effects as of the result of utilizing a pretreatment sequence of this invention.

The deposition of this non-metallic chemical coating must be applied within the frame work of the inventive criteria disclosed below. A preferred method embodying the principles of this invention is as follows:

1. Provide a wrought or extruded aluminum article or substrate having 1–8% alloyed zinc; lesser amounts of alloyed zinc affect adhesion and greater amounts of zinc undesirably affect the physical characteristics of the aluminum. The necessity for the presence of alloyed zinc is not fully understood, but it is related to the necessity for producing a proper bonding potential at the aluminum interface which in turn will achieve good adhesion of the plated system thereover. More preferably, the substrate should be of the 7000 aluminum series containing 4–6% zinc.

2. Subject the aluminum article to a cleaning and activating cycle which removes foreign matter. The characteristics of such cycle will vary widely with the nature of the foreign matter and are synergistically formulated and sequenced to most thoroughly remove the soil or foreign matter with minimal adverse effect on surface quality of the aluminum article. Such cycle should comprise a soak in a mild alkaline cleaning solution to provide a rough general surface cleaning. This may comprise use of a proprietary cleaner S-436 produced by MacDermid which contains carbonates, detergents, surfactants and despersants. The article should be soaked for 1–4 minutes at 140°–180° F. Power spraying of the article is carried out with a similar alkaline solution at 110°–130° F. for a period of time of about 1–3 minutes, the power spray being carried out to direct the solution against the aluminum substrate with a force adequate to dislodge cakes of soil. The article is then sprayed with water for a period of 1 minute at room temperature.

3. Subject the soaked aluminum substrate to an etching cleaner for producing an even etching of the aluminum surface. The etching solution is sufficiently alkaline to provide an even etch on the surface when the aluminum is subjected for a period of time of 1–3 minutes; the solution being maintained at a temperature of about 100°–150° F. A preferred commercial solution, designated Alstan 20, is a strong etching solution containing sodium hydroxide, phosphates and surfactants. An alternative solution preparation may comprise: adding a powder in the proportion of 6–11 oz./gal. of water, the powder containing a maximum of 3–5% moisture, 68% sodium metaphosphate, and 10% maxium sodium carbonate. After soaking, the aluminum is then subjected to a water rinse to remove the products of the etching alkaline solution, the water rinse being carried out for about 2 minutes at room temperature.

4. Cathodically remove the oxide film from the aluminum article by subjecting the article to a cathodic acid treatment. The article is dipped in a mild acid solution for a period of about 0.75–2 minutes, the solution being maintained in the temperature range of 60°–80° F. A preferential acid solution may contain 2–12% by volume of sulfuric acid (optimally 7%) with acid fluoride salts such as 0.25 oz./gal. ammonium bi-fluoride, and/or hydrogen peroxide. The electrolytic cell carries a current density of about 10 ASF, and the article is connected as the cathode. After treatment, the article is rinsed so that the products of the film removal are washed away.

5. Subject the oxide and contaminant free article to an electrolytic cell containing at least cyanide salts and preferably borate salts. The article is connected as the cathode and a current is passed through the electrolyte with 10–30 ASF, preferably 10 ASF, for a period of time of 0.75–2 minutes, with the electrolyte being maintained at a temperature of 60°–180° F. The electrolyte is preferably comprised of 2–14 oz./gal. of potassium cyanide, although cyanide or any other equivalent cyanide salt may be employed, 3–12 oz./gal. of boric acid, although any other equivalent borate salt may be employed. The pH must be 9.0–10.5 as evidenced by test data, but it is believed an operable range would be 7.5–10.5, even though not fully tested.

The article should preferably be immersed in said electrolyte with the current on for a period of 45–120 seconds permitting the cathodic cleaning to take place from the instant of immersion. The resultant electrolytically deposited coating will be comprised of residue of cyanide or potassium cyanide and boric acid in a uniform dispersion.

6. Electrodeposit a bronze strike (of a thickness about 0.0005") as a displacement coating for the cyanide and borate salt coating, within a period of 1 hour or less after the coated article has been exposed to the atmosphere. To this end, the electrolyte for the bronze strike is preferably constituted of Tin: 3.5–5.5 oz./gal.
Copper: 1.5–2.0 oz./gal.
Potassium Cyanide: 2.5–3.5 oz./gal.
Potassium Hydroxide: 0.8–1.5 oz./gal.

Tin should comprise 58–88% of the plated strike. The article is immersed in said electrolyte, preferably with the current off, for a period of 1 minute or less so that the borate and cyanide salt coating may dissolve in the aqueous solution prior to the passage of current between the cathode and anode. The anode may be preferably constituted of bronze, while the cathode is the aluminum article. Electrodeposition is carried out for a period of about 5 minutes with a current density of about 10 ASF per square foot, while electrolyte is maintained at a temperature of about 70°–90° F.

7. Electrodeposit copper of about 0.0005" thickness. The deposit may consist of progressive layers including (a) a copper strike of 0.00005" utilizing an electrolyte having a general composition of 3.0 oz./gal. CuCn, 2.0 oz./gal. NaCn, 1.5 oz./gal. sodium hydroxide (current density—10 ASF; time 5 minutes; and temperature 120°–150° F.); (b) plating an acid copper layer from a copper sulfate and sulfuric acid electrolyte, the thickness being about 0.0004", and (c) plating a cyanide copper strike to a thickness of about 0.00005". Rinsing is provided after each of the copper layers.

8. The substrate from the previous steps is then preferably dipped in an acid containing 1% $H_2SO_4$ (by volume) for a period of time of about 1 minute.

9. The previously plated substrate is then provided with a brass plate or other optional plating procedure which may include semi-bright nickel.

10. The article is provided with a decorative finish which includes bright nickel and chromium. Plating is carried out to a thickness minimum of about 0.0003", the nickel being bright and the nickel electrolyte being comprised of 40 oz./gal. of $NiSO_4.6H_2O$, 18 oz./gal. of $NiCl_2.6H_2Om$ 6.5 oz./gal. of $H_3BO_3$ with brightening and wetting agents, the nickel plated substrate then being rinsed in water. An outer chromium plate to a thickness of about 0.000005" is provided using an electrolyte containing preferably 45 oz./gal. of $CrO_3$ and 0.4 oz./gal. of $H_2SO_4$ and applying a current density of about 175 ASF. The chromium plated substrate is then rinsed in water at about 190°-200° F. and dryed by blowing hot air thereover.

The following series of test examples demonstrate the improved adherency of the inventive process.

Several test specimens were prepared from aluminum alloys selected from the 6000 and 7000 series. Except where indicated a 7029 aluminum alloy will be considered as being employed. Each specimen was 4" wide and 20" long, formed into a C shaped bumper section along the length. The specimens were sequentially immersed in a series of tanks, each containing a bath of about 18 gallons, according to the cleaning, salting, and plating steps required.

Each specimen was subjected to cleaning which comprised (a) a one minute soak in an alkaline solution (S 436) at 160° F., (b) a 30 second soak in an etching solution (Alstan 20) at 125° F., and (c) a 45 second to one minute cathodic soak in an acid cleaning solution containing $H_2SO_4$ at 10 ASF and at room temperature (lead anodes). Variations from this cleaning cycle are noted.

Each specimen, except where noted otherwise, was subjected to salting, which comprised connecting the specimens as a cathode for 45 seconds in an aqueous electrolyte containing 7 oz./gal. of KCN and a Ph of 9-10.5.

Each specimen was then plated, which in most cases involved only a bronze strike. The plating was carried out for 5 minutes in an electrolyte containing Sn, Cu, Cn, and OH as noted, at 10 ASF.

The results as tabulated (see below) show that when the Ph was controlled to 9.0-10.5, and a cathodic cyanide salting was applied, followed by a thin bronze strike, good plating adhesion was consistently obtained. Test samples were also run to determine the amount of contamination that can be tolerated in the cathodic cyanide electrolyte. Fe, when varied from 5-96 ppm and lead from 0-30 ppm were found not to alter good results; addition of 900 grams of $Al_2(SO_4)_3$ did not affect good results. The best results were obtained with a combination of cyanide and borate salts. Use of $NaBF_4$ reduced quality; total elimination of the salting treatments clearly destroyed quality.

Varying the bronze plating bath to additionally contain from 1 to 5 oz./gal. of $H_3BO_3$ seemed to improve plating adhesion. Altering the temperature of the bronze plating solution between 70°-120° F. did not affect plating quality; at 130° F. or over, blisters began to appear. Altering the tin proportion of the bronze plating solution to plate out 58-87.5% tin in the bronze did not injure plating quality. The live entry into the bronze plating solution was found to be a detriment. The salts on the article surface inhibited good plating; a period of time was needed for the salts to drop or wash off and then for plating to commence.

Varying the cleaning cycle from use of an alkaline cleaner, strong alkaline etchant and then a cathodic acid treatment, produced a lesser quality of adhesion. For example, replacement of the cathodic acid treatment by $H_2O_2$ reduced quality; substitution of a cathodic carbonate and phosphate solution treatment for the cathodic acid lowered quality.

| Specimen | Alloy | Cleaning Cycle Variation | Salting Parameters: Bath Concentration | Ph | Time | Temp | Current Density On | Current Density ASF | Transfer Time (sec) | Plating: Bronze Electrolyte (grams/20 gal. water) | Current On | Current Density | Time (min) | Temp | Other Plating | Results |
|---|---|---|---|---|---|---|---|---|---|---|---|---|---|---|---|---|
| 1 | 7029 | Substituted $H_2O_2$ dip for cathodic acid | 7–14 oz/gal KCN 1 oz/gal KOH | 6.0 | 45" | 120° F. | yes | 10 | 45 | Sn 5.34 CN 3.37 Cu 2.21 OH 1.20 | yes | 10 | 5 | 80° F. | None | poor adhesion |
| 2 | " | Substituted $H_2O_2$ dip for cathodic acid | 7–14 oz/gal KCN 1 oz/gal KOH | 9.8 | " | " | " | " | " | Sn 5.34 CN 3.37 Cu 2.21 OH 1.20 | " | " | " | " | " | good adhesion except on back edge and except for ringlet discoloration |
| 3 | " | Substituted $H_2O_2$ dip for cathodic acid | 7–14 oz/gal KCN 1 oz/gal KOH | " | " | " | " | " | " | Sn 5.34 CN 3.37 Cu 2.21 OH 1.20 | No for 1 min | " | " | " | " | same as in #2, but eliminated ringlets |
| 4 | " | None (used cathodic acid 45" @ 10 ASF) | 7–14 oz/gal KCN 1 oz/gal KOH | " | " | " | " | " | " | Sn 5.34 CN 3.37 Cn 2.21 OH 1.20 | No for 1 min | " | " | " | " | good adhesion all over |
| 5 | " | None (used cathodic acid 45" @ 10 ASF) | 7–14 oz/gal KCN 1 oz/gal KOH | " | " | " | " | " | 180 | Sn 5.34 CN 3.37 Cu 2.21 OH 1.20 | No for 1 min | " | " | " | " | good adhesion all over |
| 6 | " | None (used cathodic acid 45" @ 10 ASF) | 7–14 oz/gal KCN 1 oz/gal KOH | " | " | " | " | " | 600 | Sn 5.34 CN 3.37 Cu 2.21 OH 1.20 | No for 1 min | " | " | " | " | good adhesion all over |
| 7 | " | None (used cathodic acid 45" @ 10 ASF | 7–14 oz/gal KCN 1 oz/gal KOH | " | " | " | " | " | 1200 | Sn 5.34 CN 3.37 Cu 2.21 OH 1.20 | No for 1 min | " | " | " | " | good adhesion all over |
| 8 | " | None (used cathodic acid 45" @ 10 ASF) | 7–14 oz/gal KCN 1 oz/gal KOH | " | " | " | " | " | 3600 | Sn 5.34 CN 3.37 Cu 2.21 OH 1.20 | No for 1 min | " | " | " | " | good adhesion all over |
| 9 | " | None (used cathodic acid 45" @ 10 ASF) | 7–14 oz/gal KCN 1 oz/gal KOH | " | " | " | " | 15 | 3 hrs | Sn 5.34 CN 3.37 Cu 2.21 OH 1.20 | No for 1 min | 15 | " | " | " | some lost adhesion |
| 10 | " | None (used cathodic acid 45" @ 10 ASF) | 7–14 oz/gal KCN 1 oz/gal KOH | 9.0 | " | " | " | 10 | 45 | Sn 5.34 CN 3.37 Cu 2.21 OH 1.20 | No for 1 min | 10 | " | " | " | good adhesion |
| 11 | " | None (used cathodic acid 45" @ 10 ASF) | 7–14 oz/gal KCN 1 oz/gal KOH | 12.4 | " | " | " | " | " | Sn 5.34 CN 3.37 Cu 2.21 OH 1.20 | No for 1 min | " | " | " | " | lost some adhesion on face |
| 12 | | eliminated S436 and added $H_2O_2$ dip - 1 min | eliminated cathodic cyanide and substituted Alstan 80 | 10.0 | 5 min | " | " | 15 | 20 | Sn 5.34 Cn 3.37 Cu 2.21 OH 1.20 | No for 1 min | " | " | " | " | lost some adhesion |
| 13 | " | None | 7.08 oz/gal Cn 4.92 oz/gal $H_3BO_3$ Fe-76 ppm Al 102 ppm | 9.4 | 45 | 120 | yes | 10 | 45 | Sn 5.34 CN 3.37 Cu 2.21 OH 1.20 | No for 1 min | " | " | " | " | excellent adhesion |
| 14 | " | " | 7.08 oz/gal Cn 4.92 oz/gal $H_3BO_3$ Fe-76 ppm Al 102 ppm | 9.7 | " | " | " | 20 | 180 | Sn 5.34 CN 3.37 Cu 2.21 OH 1.20 | No for 1 min | " | " | " | " | " |
| 15 | " | " | 7.08 oz/gal CN 4.92 oz/gal $H_3BO_3$ | 9.7 | " | " | " | 30 | " | Sn 5.34 CN 3.37 Cu 2.21 OH 1.20 | No for 1 min | " | " | " | " | " |

-continued

| Specimen | Alloy | Cleaning Cycle Variation | Salting Parameters: Bath Concentration | Ph | Time | Temp | Current Density On | Current Density ASF | Transfer Time (sec) | Plating: Bronze Electrolyte (grams/20 gal. water) | Current On | Density | Time (min) | Temp | Other Plating | Results |
|---|---|---|---|---|---|---|---|---|---|---|---|---|---|---|---|---|
| 16 | " | eliminated S436 | Fe-76 ppm Al 102 ppm 7.08 oz/gal Cn 4.92 oz/gal $H_3BO_3$ | 10.5 | " | " | | 10 | 45 | Sn 3.57 Cn 1.28 Cu 1.20 OH 1.13 (74.8% tin) | No for 1 min | " | " | " | " | lost some adhesion |
| 17 | " | " | Fe-76 ppm Al 102 ppm 7 oz/gal CN 4 oz/gal $NaBF_4$ | 10.8 | " | " | " | 15 | 180 | Sn 3.57 Cn 1.28 Cu 1.20 OH 1.13 (74.8% tin) | No for 1 min | 15 | " | " | " | poor adhesion |
| 18 | " | None | eliminated cathodic cyanide and substituted cathodic 15% $Na_2Co_3$ & $Na_3PO_4$ | 9.5 | 45 | 60 | " | 40 | 45" | Sn 3.57 Cn 1.28 Cu 1.20 OH 1.13 (74.8% tin) | No for 1 min | 10 | " | " | " | no good |
| 19 | " | None | eliminate salting and used cathodic 10% $H_2SO_4$ + HF | " | " | 45 | " | 50 | " | None | No for 1 min | | | | Normal decorative plating | no good |
| 20 | " | None | 7-14 oz/gal KCN 4 oz/gal $H_3BO_3$ | 9.8 | " | " | " | 10 | " | " | No for 1 min | " | " | " | (a) brass in place of Bronze (b) acid Cu in place of Bronze | (a) no good (b) no good |
| 21 | 7016 | " | 7-14 oz/gal KCN 4 oz/gal $H_3BO_3$ | " | " | " | " | " | " | " | No for 1 min | " | " | " | added Cu strike and normal Ni, Cr plating | good adhesion |
| 22 | 6010 | " | 7-14 oz/gal KCN 4 oz/gal $H_3BO_3$ | " | " | " | " | " | " | " | Nor for 1 min | " | " | " | None | poor |
| 23 | 7046 | eliminated cathodic acid-used $H_2O_2$ | eliminated salting | " | " | " | " | " | " | eliminated bronze strike and used nickel | No for 1 min | 20 | 5 | " | | poor |

I claim:

1. A method of plating at least one designated surface of an aluminum alloy article, comprising:

(a) selecting said aluminum alloy article to contain 1–8% zinc, (b) cleaning said surface to be free of grease and/or organic contaminants, (c) cathodically cleaning said surface to be free of any oxide film, (d) while in the substantially oxide free condition, subjecting said surface to electrolysis in an electrolytic cell having an electrolyte containing a soluble cyanide and having a pH of 9–10.5 in a manner to leave a cyanide salt coating said surface after removal from said electrolyte, (e) within one hour after exposure of said surface to the atmosphere after step (d), immersing said article in an electrolytic cell arranged to displace said salt coating with an electrolytic bronze coating, and (f) electrolytically depositing a lustrous decorative coating system thereover.

2. The method as in claim 1, in which said step (c) particularly comprises immersing said cleaned article in an electrolyte constituted of an aqueous solution of 2–12% sulfuric acid, said electrolyte being energized to provide for cathodic cleaning of said article within a period of about 45 seconds.

3. The method as in claim 1, in which step (d) is carried out by immersing said cleansed article in an electrolyte constituted of an aqueous solution having 2–14 oz./gal. of a soluble cyanide, and 3–12 oz./gal. of boric acid, said article being arranged as the cathode of said electrolytic cell and which cell carries a current density of 10–30 ASF per square foot.

4. In a method of electroplating nickel and chromium onto an aluminum based article containing 1–8% zinc, the steps comprising:

(a) after having substantially removed the aluminum oxide and other contaminants from the surface of said article, immersing the cleansed article as a cathode into an electrolytic cell having an electrolyte containing an aqueous solution of a soluble cyanide, (b) controlling the pH of said electrolyte to be in the range of 9.0–10.5 and the temperature within the range of 60°–180° F., (c) applying a current through said electrolyte having a current density of 10–30 ASF per square foot for a period of time of at least 0.75 minutes, (d) withdrawing said article from said electrolyte without protection from the atmosphere, and (e) within a period of 1 hour or less after exposure to the atmosphere, immersing said article in a bronze plating cell and passing a current therethrough, with the article constituted as a cathode, to deposit a thin bronze coating.

5. The combination of steps as in claim 4, in which the thickness of said bronze coating is about 0.0005".

6. A method of plating aluminum comprising:

(a) preparing an aluminum based article containing 1–8% zinc and having a surface designated to be plated, (b) cleansing said designated surface to be substantially free of contaminants including any oxide film, (c) electrolytically while in the oxide free condition, immersing said cleansed article as a cathode into an electrolytic cell having an electrolyte constituted of an aqueous solution with 2–12% sulfuric acid, (d) immediately after removal of said article from the electrolyte in step (c), subjecting said surface to electrolysis in an electrolytic cell having an electrolyte containing a soluble cyanide and boric acid and having a pH of 9–10.5 in a manner to leave a coating containing a uniform dispersion of cyanide and borate salts after removal from said electrolyte, (e) within a period of 1 hour after exposing said coated article to the atmosphere, immersing said coated article in an electrolytic cell having an electrolyte effective to deposit a bronze strike, said coating separating from said article by dissolution upon coming into contact with said aqueous electrolyte, (f) after a period of no less than 1 minute, passing current through the electrolyte in step (e) so as to effect the deposition of a bronze coating in place of said cyanide and borate salt coating, and (g) depositing thereover a metallic coating system of desired luster and decoration.

7. The method as in claim 6, in which step (c) is carried out with a current density of about 10 ASF across an electrolytic cell, the electrolyte being maintained at a temperature of about 60°–80° F. and the electrolyzing being carried out for a period of about 45 seconds.

8. The method as in claim 6, in which the electrolyte of step (d) is comprised of an aqueous solution having 2–14 oz./gal of potassium cyanide and 3–12 oz./gal. of boric acid.

9. The method as in claim 6, in which the electrolyte of step (d) is maintained at a temperature of 60°–80° F. and the electrolytic cell is energized for a period of time of about 0.75–2 minutes with a current density of 10–30 ASF.

10. The method as in claim 6, in which the electrolyte of step (e) comprises a solution effective to plate out a bronze strike having 70% tin and 30% copper, said electrolytic cell being energized for a period of about 5 minutes at a current density of about 10 ASF.

11. The method as in claim 6, in which the content of the bronze strike contains 58–88% tin.

* * * * *